United States Patent [19]

Kivimaa

[11] 4,147,193

[45] Apr. 3, 1979

[54] CUTTER HEAD

[76] Inventor: Eero M. Kivimaa, Linnankoskenkatu 15 A, 00250 Helsinki 25, Finland

[21] Appl. No.: 817,452

[22] Filed: Jul. 20, 1977

[30] Foreign Application Priority Data

Jul. 30, 1976 [FI] Finland ..... 762180

[51] Int. Cl.[2] ..... B27G 13/04; B27L 11/02

[52] U.S. Cl. ..... 144/235; 144/162 R; 144/176; 144/323; 407/31; 144/220

[58] Field of Search ..... 144/162 R, 176, 218, 144/220, 231, 235, 236, 237, 326 R, 326 A, 326 B, 326 C, 321, 323; 407/31

[56] References Cited

U.S. PATENT DOCUMENTS

| | | | |
|---|---|---|---|
| 1,472,960 | 11/1923 | Conklin | 144/235 |
| 3,330,315 | 7/1967 | Tomlinson | 144/162 R |
| 3,360,024 | 12/1967 | Traben | 144/220 |
| 3,570,567 | 3/1971 | Hickman | 144/220 |
| 3,746,062 | 7/1973 | Nystrom et al. | 144/176 |
| 3,776,288 | 12/1973 | Johnson | 144/235 |
| 3,872,902 | 3/1975 | Nilsson | 144/162 R |

*Primary Examiner*—Donald R. Schran
*Assistant Examiner*—W. D. Bray
*Attorney, Agent, or Firm*—Ladas, Parry, Von Gehr, Goldsmith & Deschamps

[57] ABSTRACT

A cutter head the entire cutting width of which is divided into a few parallel cutting strips defined by respective sets of cutting knives. The diameters of the cutting circles of the knives of the different sets increase stepwise in the direction away from the log. The angle of inclinaton of the main cutting edge of the knives in relation to the axis rotation of the cutter head is large in the case of the knives defining the cutting strips placed closest to the log and small in the case of the knives defining the cutting strips placed more distant from the log.

7 Claims, 2 Drawing Figures

CUTTER HEAD

Figure 1:
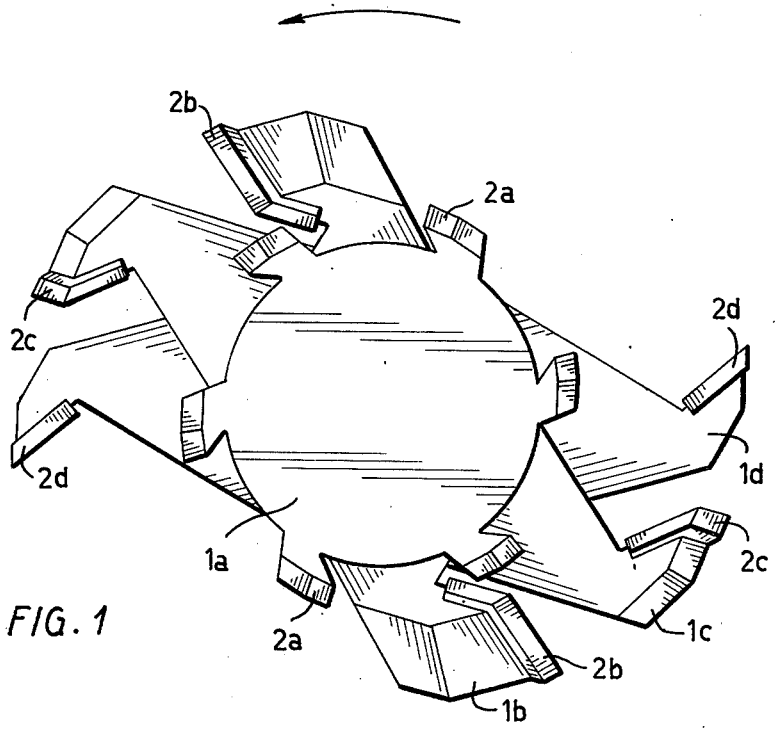

The subject of the present invention is a cutter head especially for canter-chipping of logs or for edging of boards. In one known form of cutter head, the axis of rotation of the cutter head is substantially perpendicular to the direction of feed of the log, and the entire cutting width of the cutter head is divided into a few parallel cutting strips defined by respective sets of cutting knives. The main cutting edges of the knives are straight and the diameters of the cutting circles defining the knives of the different strips increase stepwise when moving away from the log. The knives defining adjoining cutting strips are staggered one after the other so that the knife defining the outer strip always cuts before the knife defining the next strip, of a smaller diameter. By use of such cutter heads, canter-chippers cut slabs from logs and chipper-edgers cut the edge portions of boards straight into chips. As these machines have become more common, the problem of the quality of the chips obtained from them has become over more important.

The inventor has discovered, as a result of studies concerning the cutter head performed over number of years, that the quality of the chips, besides depending on the quality of wood and on the cutting speed, above all depends on the knife angles. It has been found that of particular importance is the so-called inclination angle, which indicates how much the straight main cutting edge of the knife, cutting through the grains of the tree, or the projection of said edge on a plane passing through the axis of the cutter head, differs from the direction of the axis of the cutter head. This angle is also important, because the size of the cutter head, in particular its maximum diameter, is largely dependent on the angle of inclination.

The present invention, which is concerned with the very angle of inclination of the knife, has been achieved on the basis of two facts discovered in the studies:

1. From the point of view of the quality of the chips, a large angle of inclination, approximately 65°, has been ascertained as highly favourable.

2. On the other hand, it has been noticed that most of the chipping is ordinarily performed by a narrow portion of the cutter head facing towards the lumber, whereas most of the cutting width of the cutter head functions as a reserve zone, in itself necessary because of butt expansions, curvature, and possible false guiding of the log, which occasionally occur in connection with logs, the quantity of wood chipped by the reserve zone being, however, very small.

These study results have yielded the cutter head construction in accordance with the invention, which is characterized in that the angle of inclination of the main cutting edge of the knives, or of the projection of said edge on a plane passing through the axis of the cutter head, in relation to the axis of the cutter head is large, about 55° to 75°, in the case of the knives defining the cutting strips or strip placed closest to the log and small, about 30° to 0°, in the case of the knives defining the cutting strips placed more distant from the log.

Owing to this arrangement of the angle of inclination of the main cutting edges, the cutter head produces excellent chips, but the diameter of the cutter head and of its cutting circles can, nevertheless, be kept small, as a result of which it is possible to use a high speed of rotation and a small number of knives.

The inventor has previously described a cutter head which proved highly useful in practice and in which the entire cutting width of the cutter head is divided into a few parallel cutting strips, the diameters of the knife circles defining which strips increase stepwise when moving outwards from the side nearest the lumber, and the knives, few in number, of the different strips, are, moreover, staggered stepwise one after the other so that the knife of an outer strip always cuts first. The cutting strip next to the wood is narrower than the others, about 3 to 6 mm, and, employs a large number of knives (about two or three times the number employed for the knives defining the other strips) in order to obtain an excellent smooth surface, in which case the length of the chips is correspondingly shorter. A large angle of inclination of the knife is, in itself, also highly advantageous from the point of view of the cutting finish—and the finish is improved when the thickness of the layer to be cut off is reduced.

The present invention is well suitable for this earlier construction and involves a highly remarkable further development of same.

According to a certain embodiment, it is advantageous that the total cutting width of the cutting strips or strip defined by knives with the large angle of inclination, placed next to the lumber to be worked, is 10 to 30 percent of the entire cutting width of the cutter head and the total cutting width of the cutting strips defined by knives with small angle of is, correspondingly 90 to 70 percent of the entire cutting width of the cutter head.

Figure 2:
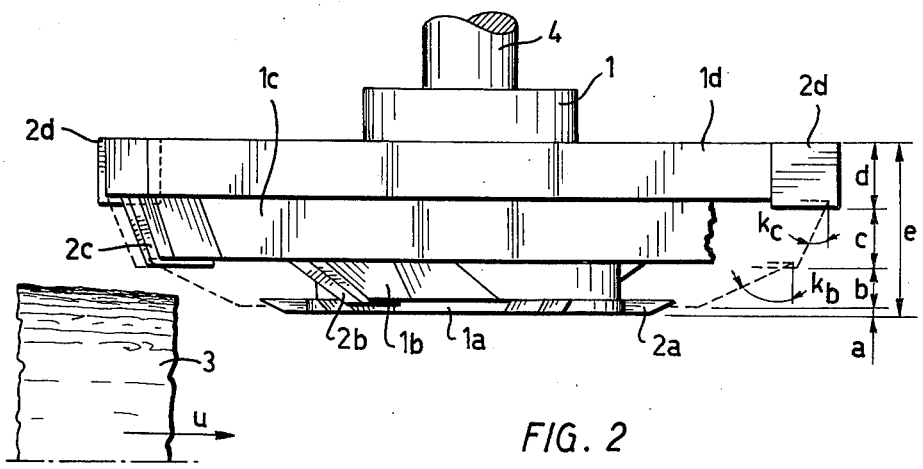

A preferred embodiment of the cutter head in accordance with the invention will be described below more closely by means of numerical examples and with reference to the attached drawing, wherein FIG. 1 shows a schematic view of a left-hand cutter head, when viewed in the direction of feeding of the log, as viewed from the side of the log, and FIG. 2 shows the cutter head as viewed from the top.

The illustrated cutter head comprises a body 1 to which two-end knife shafts 1*b*, 1*c* and 1*d* are fastened in an appropriate way, the knives proper 2*b*, 2*c* and 2*d* being, on the other hand, fastened to said shafts. A knife dish 1*a* is fastened to the body 1 and incorporates 6 narrow surface knives 2*a*. The log 3 is fed towards the cutter head at a speed u. The cutter head has a shaft 4, which is substantially perpendicular to the feeding direction u and movable in the direction of the shaft. The letter k and the sub-index a . . . d corresponding the different strips denotes the angles of inclination of the knives, which indicate how much the direction of the main cutting edge of the knife, cutting through the grains of the tree, or the projection of said edge on a plane passing through the axis of the cutter head, differs from the direction of the shaft 4.

In the drawing, which has been achieved by means of interpretation of the results of the research work and which is intended to illustrate the content of the invention, the cutting strips have the following widths: total width e=120 mm, a=5 mm, b=25 mm. The zones a and b function as the cutting zone proper, having a total width of 30 mm, i.e. ¼ of e. The strips c and d, with little working duties, are each 45 mm wide, and thus together represent ¾ of the total width e of the cutter head. The corresponding angles of inclination k are in this example $k_a$ and $k_b$ 65° each, $k_c$=25°, and $k_d$=0°.

Out of the extensive laboratory studies preceding the invention, by way of example, it is justified briefly to describe a test series concerned with the working of an average quality spruce, in which test series eight knives were used with angles of inclination varying between k=5° to 75°.

The best chips were obtained by means of a knife of an angle of inclination of k=65°, the proportion of chipping fines that passed through holes of 6 mm screen being 0.7 percent in the chips obtained with that angle of inclination. This proportion of chipping fines is one of the most important criteria of the quality of chips. This proportion was less than ⅓ of the chipping fines proportion of 2.3 percent, obtained with the angle of inclination of 45°—maybe the commonest value of k in practice. On the other hand, the chipping fines proportion of 2.9 percent, corresponding the value of k=25°, was not yet very high, but at k=5° the chipping fines proportion was already 7.2 percent.

On the other hand, a brief mention should be made about the computer studies by means of which it was established how the quantity of wood to be chipped is distributed among the different sections of the cutting width of the cutter head. This is illustrated by an example in which a slab which is slightly thicker than average is removed from a log which is slightly more conical in shape than average by means of the relatively narrow (e=120 mm) cutter head described above. In the computer examination the log, whose length is 4.5 mm, is regarded as a mathematical truncated cone, whose top diameter d=200 mm and butt diameter is 260 mm. If the thickness of the slab to be removed is at the top 10 mm and at the butt, consequently, 40 mm, the slab represents about 6 percent of the entire volume of the log. When the top is being cut, 10 mm of the width of the cutter head comes into use, and at the butt 40 mm, i.e. ⅓ of the total width e. On the contrary, if we examine the distribution of the cubic volume of the slab to be removed, the computer calculations indicate that the share of the 5 mm strip of the cutter head next to the log, i.e., in the present case, the smoothing strip, is about 26 percent of the entire volume of the slab. Correspondingly, the total share of the 30 mm wide cutting zone proper, a+b, would be 97 percent, and the remaining share of the reserve zone representing ¾ of the width of the cutter head, c+d, would be only 3 percent.

The described examples illustrate how purposeful it is to construct the cutter head in accordance with the principles of the present invention. On the other hand, it is possible to apply them to practice by using the cutting head embodiment described in earlier patent applications of the inventor, in which the cutting width of the cutter head is divided into a few strips and in which the formation of chips is open and the removal of chips free.

As to its details, the cutter head may of course be constructed in many different ways within the scope of the following patent claims. Thus, instead of the four strips described in the present application, the number of cutting strips may also be 2 or 3 or even higher than 4.

What I claim is:

1. A cutter head especially for canter-chipping of logs or for edging of boards, having an axis of rotation which is substantially perpendicular to the direction of feed of the log, the cutter head being made up of at least two sets of cutting knives, which sets of knives define respective cutting circles, the diameters of the cutting circles increasing stepwise in the direction away from the log along said axis of rotation, the entire cutting width of the cutter head thereby being divided into parallel cutting strips defined by said sets of knives, each cutting knife having a main cutting edge which is straight, and the knives of two adjacent sets, defining smaller and larger cutting circles respectively, said sets of knives being staggered one after the other so that a knife of the set defining the larger cutting circle always cuts before a knife of the set defining the smaller cutting circle, the angle of inclination of the projection, on a plane passing through said axis of rotation, of the main cutting edge of each knife of the set defining the smallest cutting circle being substantially in the range from 55° to 75° and the angle of inclination of the main cutting edge of each knife of the set defining the largest cutting circle being substantially in the range from 0° to 30°.

2. A cutter head as claimed in claim 1, comprising at least three sets of knives defining respective cutting circles, and wherein the angle of inclination of the projection, on a plane passing through said axis of rotation, of the main cutting edge of each knife of the set defining the second smallest cutting circle is substantially in the range from 55° to 75°.

3. A cutter head as claimed in claim 2, wherein the angle of inclination of the projection, on a plane passing through said axis of rotation, of the main cutting edge of each knife of the sets defining the smallest cutting circle and the second smallest cutting circle is substantially 65°.

4. A cutter head as claimed in claim 1, wherein the angle of inclination of the projection, on a plane passing through said axis of rotation, of the main cutting edge of each knife of the set defining the smallest cutting circle is substantially 65°.

5. A cutter head as claimed in claim 1, comprising at least three sets of cutting knives, and wherein the angle of inclination of the projection, on a plane passing through said axis of rotation, of the main cutting edge of each knife of the set defining the second largest cutting circle is substantially in the range from 0° to 30°.

6. A cutter head as claimed in claim 5, wherein the angle of inclination of the projection, on a plane passing through said axis of rotation, of the main cutting edge of each knife of the set defining the largest cutting circle is substantially 0° and the angle of inclination of the projection, on a plane passing through said axis of rotation, of the main cutting edge of each knife of the set defining the second largest cutting circle is substantially 25°.

7. A cutter head as claimed in claim 1, wherein the angle of inclination of the projection, on a plane passing through said axis of rotation, of the main cutting edge of each knife of the set defining the largest cutting circle is substantially 0°.

* * * * *